US007682130B2

(12) United States Patent
Jurjevic

(10) Patent No.: US 7,682,130 B2
(45) Date of Patent: Mar. 23, 2010

(54) DEVICE AND METHOD FOR COOLING A HOUSING OF A GAS TURBINE OR A COMBUSTION CHAMBER

(75) Inventor: Zdenko Jurjevic, Nussbaumen (CH)

(73) Assignee: ALSTOM Technology Ltd, Baden (CH)

( * ) Notice: Subject to any disclaimer, the term of this patent is extended or adjusted under 35 U.S.C. 154(b) by 935 days.

(21) Appl. No.: 11/208,669

(22) Filed: Aug. 23, 2005

(65) Prior Publication Data

US 2006/0191274 A1 Aug. 31, 2006

(30) Foreign Application Priority Data

Aug. 23, 2004 (DE) ..... 10 2004 041 271

(51) Int. Cl.

| | |
|---|---|
| ***F01D 11/00*** | (2006.01) |
| ***F01D 25/26*** | (2006.01) |
| ***F04D 29/00*** | (2006.01) |
| ***F25D 17/04*** | (2006.01) |

(52) U.S. Cl. ..... 415/175; 415/108; 415/176; 62/186

(58) Field of Classification Search ..... 62/186; 236/49.3; 416/96 R, 93 R; 415/108, 175, 415/176

See application file for complete search history.

(56) References Cited

U.S. PATENT DOCUMENTS

| | | | | |
|---|---|---|---|---|
| 5,967,743 | A * | 10/1999 | Meylan | 415/115 |
| 6,173,561 | B1 | 1/2001 | Sato et al. | 60/39.02 |
| 6,341,485 | B1 | 1/2002 | Liebe | 60/39.02 |
| 6,478,534 | B2 | 11/2002 | Bangert et al. | 415/1 |
| 2004/0228723 | A1 | 11/2004 | Dittmann et al. | 415/117 |

FOREIGN PATENT DOCUMENTS

| | | | |
|---|---|---|---|
| DE | 507129 C | * | 9/1930 |
| DE | 54 532 | | 3/1967 |
| DE | 197 51 299 C2 | | 6/1999 |
| DE | 698 13 960 T2 | | 2/2004 |
| JP | 62070614 A | * | 4/1987 |
| JP | 2000111273 A | * | 4/2000 |
| WO | WO 00/11324 | | 3/2000 |
| WO | WO 03/038243 A1 | | 5/2003 |

* cited by examiner

*Primary Examiner*—Chen-Wen Jiang
(74) *Attorney, Agent, or Firm*—Steptoe & Johnson LLP

(57) ABSTRACT

The invention relates to a device for cooling a housing of a gas turbine and/or of a combustion chamber, in particular of a gas turbine, comprising: a cooling gas supply device with a cooling gas outlet, out of which a cooling gas stream flows when the cooling gas supply device is in operation, and with a cooling gas inlet, via which the cooling gas stream flows back to the cooling gas supply device when the cooling gas supply device is in operation; and a cooling gas path which is led through the housing in the circumferential direction of the latter and which connects a first housing connection to a second housing connection. So that a circumferential temperature difference of the housing can be set independently of an average temperature of the housing, the cooling device is equipped with a switching device for reversing the flow direction.

14 Claims, 4 Drawing Sheets

DEVICE AND METHOD FOR COOLING A HOUSING OF A GAS TURBINE OR A COMBUSTION CHAMBER

CROSS-REFERENCE TO RELATED APPLICATIONS

This application claims priority to German patent application no. 10 2004 041 271.5 filed on Aug. 23, 2004, and the entire contents of this application are expressly incorporated herein by reference thereto.

FIELD OF THE INVENTION

The present invention relates to a device and a method for cooling a housing of a gas turbine and/or of a combustion chamber, in particular the combustion chamber of a gas turbine.

BACKGROUND OF THE INVENTION

The housing of a gas turbine or of a gas turbine combustion chamber has to be cooled when the gas turbine is in operation. For this purpose, it is customary to lead a cooling gas path through the housing in the circumferential direction of the latter. Such a cooling gas path in this case connects a first housing connection, which serves, for example, as a cooling gas inlet, to a second housing connection, which serves, for example, as a cooling gas outlet. The cooling gas, when flowing through the cooling gas path, heats up. The housing correspondingly possesses a lower temperature at the cooling gas inlet than at the cooling gas outlet. This means that a circumferential temperature difference occurs in the circumferential direction of the housing. This circumferential temperature difference should not overshoot a predetermined maximum value when the gas turbine is in operation, in order to avoid damage to the housing due to thermal stresses. Furthermore, an average temperature of the housing also should not overshoot a predetermined maximum value, in order to avoid damage to the housing.

It has been shown, however, that, in conventional housing cooling, there is an interaction between the average temperature and the circumferential temperature difference of the housing. When the average temperature is reduced, for example by the lowering of the cooling gas temperature at the cooling gas inlet, this automatically leads to an increase in the circumferential temperature difference. Conversely, a raising of the average temperature, for example by an increase in the cooling gas inlet temperature, automatically leads to a reduction in the circumferential temperature difference. In conventional housing cooling, therefore, the setting of the circumferential temperature difference and the setting of the average temperature are always a compromise between a comparatively high circumferential temperature difference and a comparatively high average temperature.

SUMMARY OF THE INVENTION

The invention relates to showing a way for cooling the housing of a gas turbine or of a combustion chamber, which makes it possible, in particular, to set the circumferential temperature difference independently of the average temperature.

The present invention is based on the general idea of varying the circumferential temperature difference by changing over the flow direction in which the cooling gas flow flows through the cooling gas path from the housing. By the flow direction being changed over, the housing connection previously serving as a cooling gas inlet becomes the cooling gas outlet and the housing connection previously serving as a cooling gas outlet becomes the cooling gas inlet. As a result, the circumferential temperature difference which has occurred up till then is first reduced and subsequently reversed, insofar as the respective switching state is maintained for longer. By means of the time interval between successive changeover operations with respective reversal in the flow direction, the circumferential temperature difference can thus be set at values which are virtually as low as desired. In theory, even a circumferential temperature of about 0° C. can be set. Of critical importance in the present invention is the fact that the change in the flow direction has essentially no effect on the average temperature of the housing. By the flow direction being reversed, only the temperature distribution in the circumferential direction of the housing is varied, whereas the mean temperature of the housing remains constant. By virtue of the invention, therefore, the circumferential temperature difference can be set independently of the average temperature. It is thus possible in this way to set comparatively low values both for the circumferential temperature and for the average temperature.

To implement the invention, a cooling device according to the invention is equipped with a switching device for reversing the flow direction, which, depending on the switching position, can connect a cooling gas outlet of a cooling gas supply device selectively to the first housing connection or to the second housing connection, in order thereby to determine the respective flow direction through the cooling gas path connecting the two housing connections to one another. With the aid of a switching device of this type, the flow direction of the cooling gas in the cooling gas path can be changed over particularly simply, without the operation of the cooling gas supply device having to be varied for this purpose.

In principle, the switching device may have any desired construction and, in particular be equipped with any desired suitable switching members, with the aid of which the connection between the cooling gas outlet of the cooling gas blower, on the one hand, and one or the other housing connection, on the other hand, can be switched internally. A switching device is preferred, however, which operates with a flap arrangement, in order to define and vary internal paths by means of which the cooling gas outlet can be connected selectively to one or the other housing connection. A flap arrangement of this type possesses a simple construction, can be implemented cost-effectively and operates reliably.

The cooling device is equipped with a switching device for reversing the flow direction, which can be changed over between a first switching position, in which it connects the cooling gas outlet to the first housing connection and the cooling gas inlet to the second housing connection, and a second switching position, in which it connects the cooling gas outlet to the second housing connection and the cooling gas inlet to the first housing connection.

Further important features and advantages of the present invention may be gathered from the drawings and from the accompanying figure description with reference to the drawings.

BRIEF DESCRIPTION OF THE DRAWINGS

Preferred exemplary embodiments of the invention are illustrated in the drawings and are explained in more detail in the following description, the same reference symbols relating to identical or similar or functionally identical components. Referring to the drawings, in each case diagrammatically.

DETAILED DESCRIPTION OF THE PREFERRED EMBODIMENTS

Figure 1:
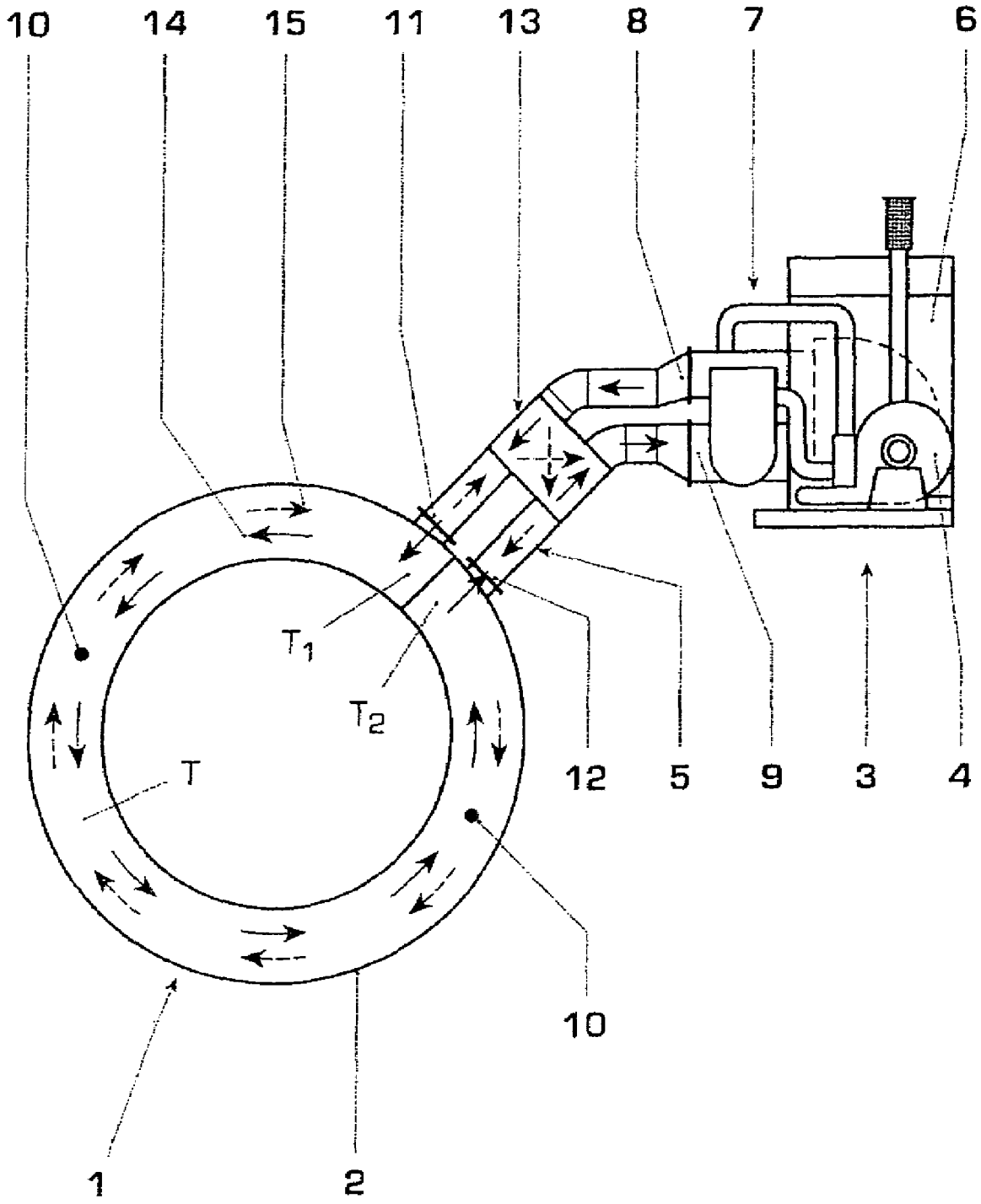
FIG. 1 shows a greatly simplified basic illustration of a gas turbine which is equipped with a cooling device according to the invention.

According to FIG. 1, a gas turbine 1 comprises a housing 2 which surrounds in the form of a jacket hot components of the gas turbine 1 which are not otherwise illustrated. It is clear, in this case, that this housing 2 can at the same time also encase a combustion chamber, not illustrated, of the gas turbine 1 or, alternatively, may serve solely for encasing a combustion chamber, preferably a gas turbine combustion chamber.

For cooling the housing 2, a cooling device 3 is provided, which has a cooling gas blower 4 for driving a cooling gas. The cooling gas used is preferably air. The cooling gas blower 4 is expediently incorporated into a closed cooling gas circuit 5, in which, moreover, a cooler 6 may be arranged. It is likewise possible for the cooling gas circuit 5 to be of open design, so that the cooling gas is sucked in from the surroundings and is subsequently ejected into the surroundings again. The cooling gas blower 4 and cooler 6 in each case form a component of a cooling gas supply device 7 which has a cooling gas outlet 8 and a cooling gas inlet 9. The cooling gas passes from the cooling gas supply device 7 through the cooling gas outlet 8 to the housing 2. In contrast to this, the heated-up cooling gas coming from the housing 2 passes through the cooling gas inlet 9 back to the cooling gas supply device 7.

Inside the housing 2, a cooling gas path 10 is formed, which is led through the housing 2 in the circumferential direction of the latter. In this case, the cooling gas path 10 connects a first housing connection 11 to a second housing connection 12.

Moreover, the cooling device 3 according to the invention is equipped with a switching device 13, with the aid of which the flow direction in the cooling gas path 10 can be reversed. In FIG. 1, unbroken arrows indicate a first flow direction 14 which is set in a first switching position of the switching device 13. In contrast to this, a second flow direction 15, which is directed opposite to the first flow direction 14, is symbolized by broken arrows. The second flow direction 15 is set in a second switching position of the switching device 13.

The switching device 13 is incorporated into the cooling gas circuit 5 in such a way that, in the first switching position, it connects the cooling gas outlet 8 to the first housing connection 11 and the second housing connection 12 to the cooling gas inlet 9. The first flow direction 14 then results from this. In contrast to this, the switching device 13, in its second switching position, connects the cooling gas outlet 8 to the second housing connection 12 and the first housing connection 11 to the cooling gas inlet 9. The second flow direction 15 then results from this.

When the cooling device 3 is operated in such a way that the flow direction of the cooling gas in the cooling gas path 10 remains the same for a longer time, that is to say when, for example, the switching device 13 has its first switching position, so that the first flow direction 14 is formed, the result of this is that a temperature gradient is formed along the cooling gas path 10. On account of the cooling action of the cooling gas on the circumference of the housing 2, a first temperature $T_1$, which is also designated below as the inlet temperature $T_1$, is set at the respective inlet of the cooling gas into the cooling gas path 10, that is to say at the first housing connection 11 in the case of the first flow direction 14. Along the cooling gas path 10, the cooling gas heats up, with the result that its cooling action decreases. A second temperature $T_2$, which is higher than the inlet temperature $T_1$, occurs correspondingly at an exit of the cooling gas path 10, that is to say at the second housing connection 12 in the case of the first flow direction 14. The second temperature $T_2$ is also designated below as the outlet temperature $T_2$. The difference between the outlet temperature $T_2$ and inlet temperature $T_1$ is designated below as the circumferential temperature difference $\Delta T$:

$$\Delta T = T_2 - T_1.$$

In order to avoid excessive thermal stresses of the housing 2 when the gas turbine 1 is in operation, it is necessary that this circumferential temperature difference $\Delta T$ is no higher than a predetermined or predeterminable upper limit value $\Delta T_{max}$. Moreover, it may be desirable that this circumferential temperature difference $\Delta T$ is no lower than a predetermined or predeterminable lower limit value $\Delta T_{min}$. The following must therefore apply:

$$\Delta T_{min} \leqq \Delta T \leqq \Delta T_{max}.$$

In order to vary the circumferential temperature difference $\Delta T$ in the cooling device 3 according to the invention the flow direction in the cooling gas path 10 can be reversed with the aid of a switching device 13. Before the reversal in flow direction, the lowest housing temperature prevails at the inlet of the cooling gas path 10, whereas the highest temperature of the housing 2 is present at the outlet of the cooling gas path 10. After the reversal of the flow direction, the temperatures at the inlet and at the outlet of the cooling gas path 10 approach one another. In this case, a zero passage may occur, in which the temperatures at the entrance and at the exit of the cooling gas path 10 are equal. Furthermore, the temperature ratio within the temperatures at the entrance and at the exit of the cooling gas path 10 can subsequently also be reversed. Thus, by the flow direction in the cooling gas path 10 being switched back and forth in a controlled manner, a predetermined and, in particular, comparatively low value for the circumferential temperature difference $\Delta T$ can readily be set. It is particularly advantageous, in this case, that an average temperature T of the housing 2 which the housing 2 has on average along its circumference does not change substantially as a result of the variation in the circumferential temperature difference $\Delta T$. That is to say, the variation in the circumferential temperature difference $\Delta T$ can be carried out independently of the average temperature T. The invention also makes it possible, moreover, to set for the average temperature T values which lie between relatively low limit values, so that, in particular, the following applies:

$$T_{min} \leqq T \leqq T_{max}.$$

In principle, the switching device 13 may be designed in any suitable desired way. Only one possible embodiment of a switching device 13 of this type is explained in more detail below with reference to FIGS. 2 and 3, and this is to be without any restriction in generality.

Figure 2:
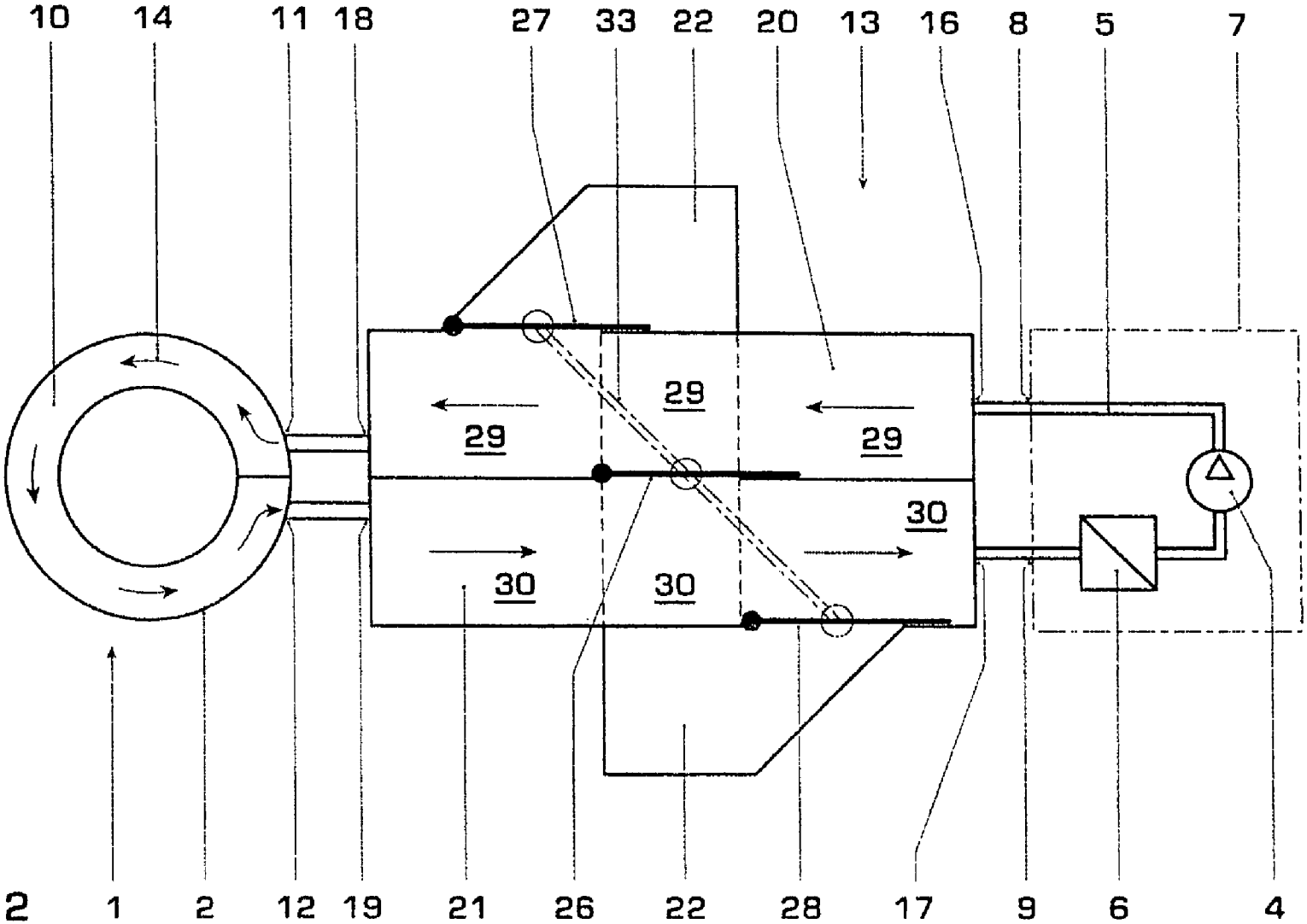
FIG. 2 shows a greatly simplified basic illustration of a switching device according to the invention in a first switching position.
Figure 3:
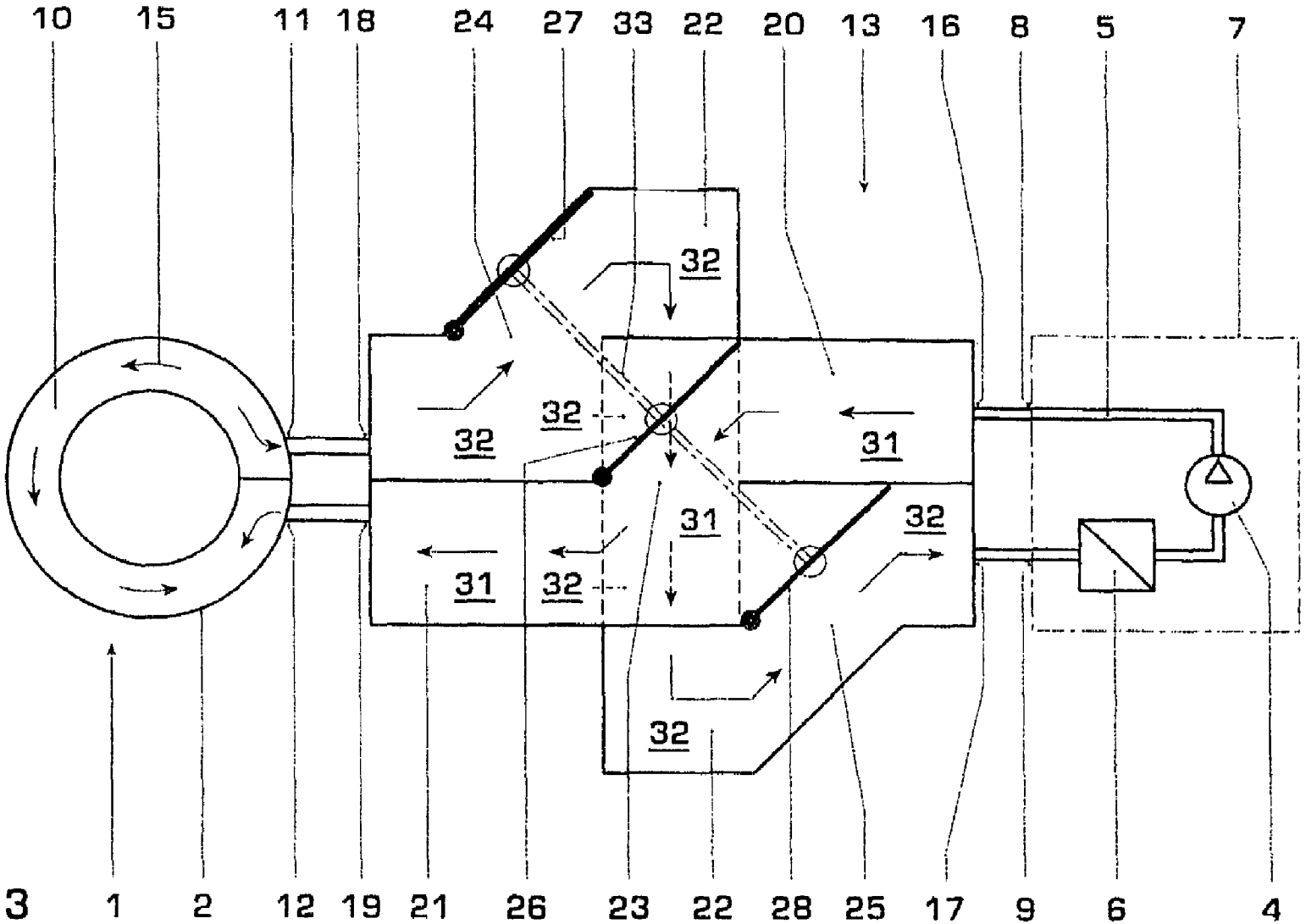
FIG. 3 shows a view in FIG. 2, but in a second switching position.

According to FIGS. 2 and 3, the switching device 13 possesses four connections, to be precise a first connection 16, a second connection 17, a third connection 18 and a fourth connection 19. The first connection 16 is connected to the cooling gas outlet 8 of the cooling gas supply device 7. The second connection 17 is connected to the cooling gas inlet 9 of the cooling gas supply device 7. The third connection 18 is connected to the first housing connection 11 of the housing 2, while the fourth connection 19 is connected to the second housing connection 12 of the housing 2.

Furthermore, the switching device 13, in the particular embodiment shown here, contains three lines, to be precise a first line 20, a second line 21 and a third line 22. Furthermore, three ports are provided, to be precise a first port 23, a second port 24 and a third port 25. The first line 20 leads from the first connection 16 to the third connection 18. The second line 21 leads from the fourth connection 19 to the second connection 17. The third line 23 leads from the second port 24 to the third port 25. The first port 23 connects the first line 20 to the second line 21 and, for this purpose, is formed, for example, in a common partition between first line 20 and second line 21. The second port 24 is formed in the first line 20, specifically preferably in a wall of the first line 20 which lies opposite the first port 23. The third port 25 is formed correspondingly in the second line 21, specifically preferably in a wall of the second line 21 which lies opposite the first port 23.

The switching device 13 is equipped, moreover, with a flap arrangement which here comprises three flaps, to be precise a first flap 26, a second flap 27 and a third flap 28. While the first flap 26 serves for controlling the first port 23, the second port 24 can be controlled by means of the second flap 27, and the third flap 28 serves for controlling the third port 25.

FIG. 2 shows the first switching position of the switching device 13, while FIG. 3 reproduces the second switching position of the switching device 13. In the first switching position, each flap 26, 27, 28 closes the port 23, 24, 25 assigned to it. The first line 20 and the second line 21 are thereby switched free, while the third line 22 is shut off. Thus, in this switching position, the flap arrangement 26-27-28 defines a first path 29 leading through the first line 20 from the first connection 16 to the third connection 18 and a second path 30 leading through the second line 21 from the fourth connection 19 to the second connection 17.

In the second switching position according to FIG. 3, the flaps 26, 27, 28 are in each case adjusted in such a way that they open the ports 23, 24, 25 assigned in each case. At the same time, in the second switching position, the first flap 26 shuts off the first line 20, specifically between the first port 23 and the second port 24. Moreover, in the second switching position, the third flap 28 shuts off the second line 21, specifically between the first port 23 and the third port 25. In the second switching position, the flap arrangement 26-27-28 can thereby define a third path 31 and a fourth path 32. While the third path 31 leads from the first connection 16 through part of the first line 20, through the first port 23 and through part of the second line 21 to the fourth connection 19, the fourth path 32 leads from the third connection 18 through part of the first line 20, through the second port 24, through the third line 22, through the third port 25 and through part of the second line 21 to the second connection 17.

It is notable, moreover, that, in the flap arrangement 26-27-28 chosen here, the three flaps 26, 27, 28 can be simultaneously adjusted with the aid of a common actuator 33. The switching device 13 shown here thus possesses a comparatively cost-effective construction which, moreover, operates particularly reliably.

According to FIG. 4, the cooling of the housing 2 may expediently be carried out as follows:

In the initial situation, the switching device 13 is in its first switching position, so that the first flow direction 14 occurs in the cooling gas path 10. The result of this is that the first temperature $T_1$ at the first housing connection 11 is lower than the second temperature $T_2$ at the second housing connection 12. That is to say, a circumferential temperature difference $\Delta T$ is set.

With the aid of appropriate temperature sensors, not shown here, the current circumferential temperature difference $\Delta T$ can be determined at position 34. Subsequently, at position 35, the check takes place as to whether the circumferential temperature difference $\Delta T$ determined lies in a predetermined value range. If this is so, "YES" applies and there is a loop back to the temperature measurement 34. If the measured circumferential temperature difference $\Delta T$ is no longer in the permissible value range at the interrogation 35, "NO" applies, and, at position 36, the interrogation preferably takes place as to whether the circumferential temperature difference $\Delta T$ determined is higher than the permissible upper limit value $\Delta T_{max}$. If this is so, "YES" applies, and, at position 37, the second flow direction 15 is then caused to be set. For this purpose, the switching device 13 is actuated for setting its second switching position. As a result, a lowering of the second temperature $T_2$ at the second housing connection 12 occurs and an increase in the first temperature $T_1$ at the first housing connection 11 occurs. That is to say, the circumferential temperature difference $\Delta T$ decreases.

The second flow direction 15 is maintained until the circumferential temperature difference $\Delta T$ falls out of the permissible values at the lower range. The interrogation 35 then again yields the answer "NO". The subsequent interrogation 36 then also yields the answer "NO". As a result, the first flow direction 14 is then set again at position 38, in that the switching device 13 is actuated correspondingly in order to set the first switching position.

Figure 4:
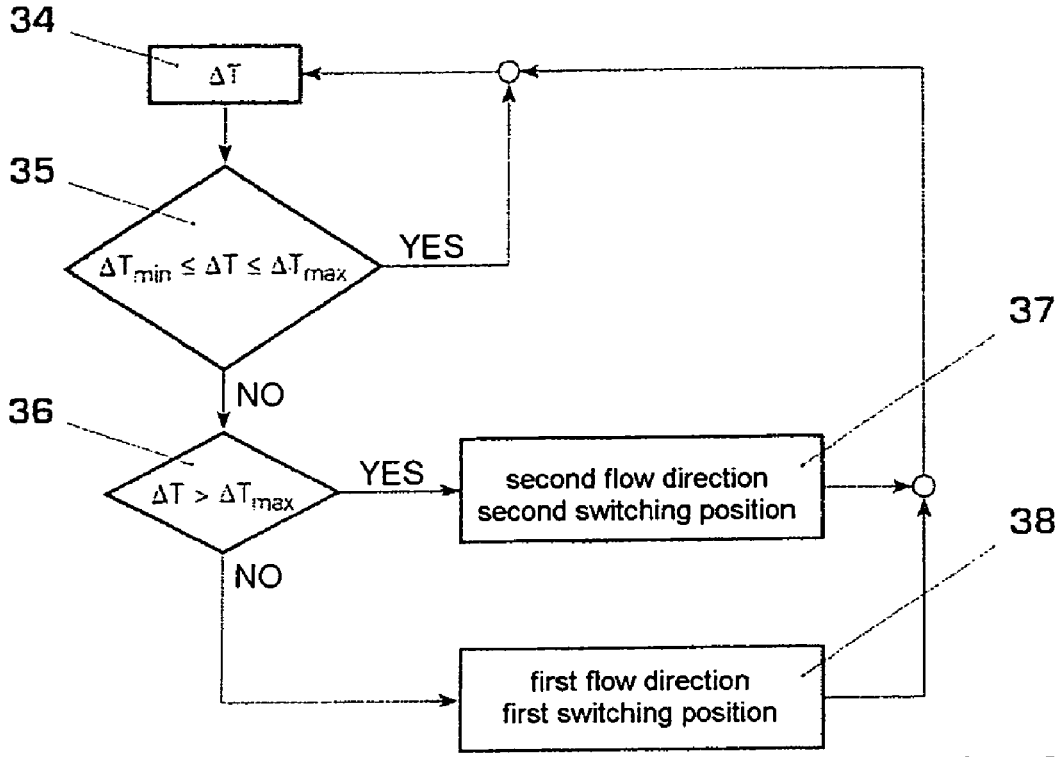
FIG. 4 shows a simplified flowchart for explaining a cooling method according to the invention for controlling a circumferential temperature difference.

It is clear that the method sequence illustrated in FIG. 4 is to be understood merely by way of example, so that, in principle, other sequences may also be envisaged. For example, there may be provision for considering the circumferential temperature difference $\Delta T$ only in amount and for reversing the flow direction whenever the measured circumferential temperature difference $\Delta T$ overshoots in amount a predetermined or predeterminable limit value $\Delta T_{max}$.

Furthermore, it is possible to reduce the circumferential temperature difference $\Delta T$ by increasing the changeover frequency or increase the circumferential temperature difference $\Delta T$ by lowering the changeover frequency.

It is essential for the invention that the variation in the circumferential temperature difference $\Delta T$ with the aid of the invention has virtually no influence on the average temperature T which can be set separately.

Figure 5:
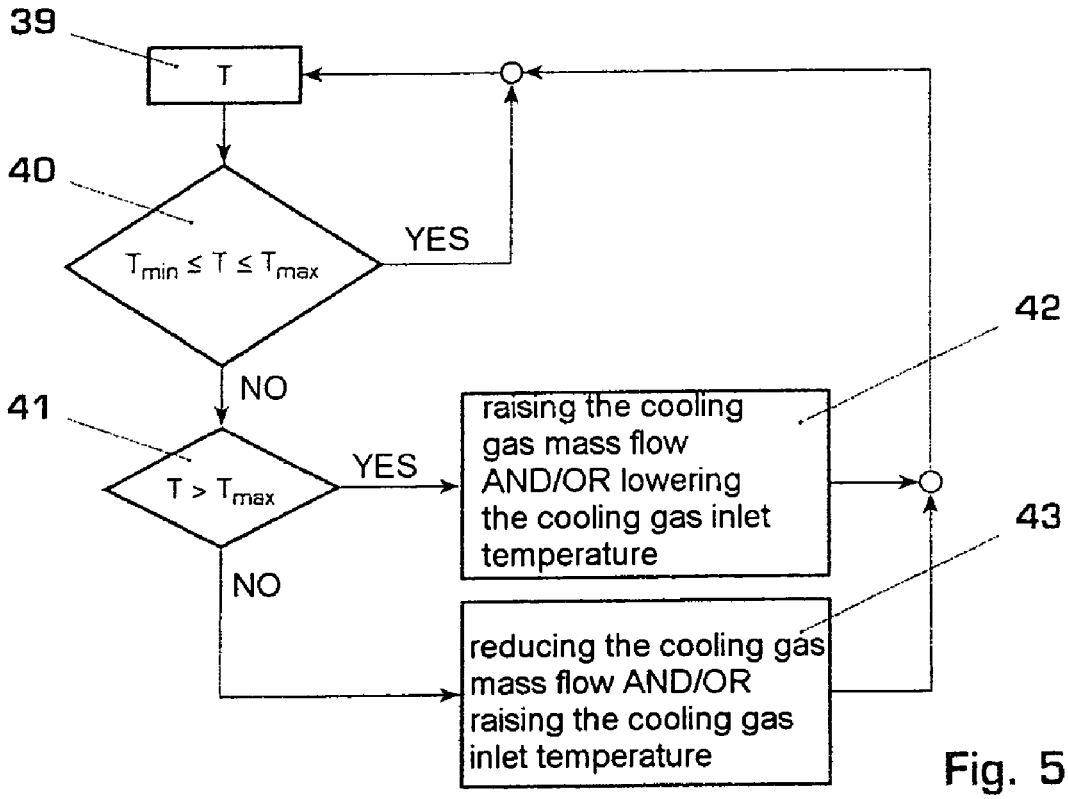
FIG. 5 shows a flowchart, as in FIG. 4, but for controlling an average temperature.

FIG. 5 shows by way of example a possible sequence for controlling the average temperature T of the housing 2. At a position 39, the mean temperature, that is to say the average temperature T of the housing 2, is determined. This average temperature T may be formed, for example, by the mean value out of the first temperature $T_1$ at the first housing connection 11 and of the second temperature $T_2$ at the second housing connection 12. For this purpose, the sensor arrangement may be utilized in order to determine the circumferential temperature difference $\Delta T$. Expediently, however, a plurality of temperature sensors, not shown here, are arranged so as to be distributed along the circumference of the housing 2, by means of which temperature sensors the average temperature T of the housing 2 can be determined.

In a subsequent interrogation 40 a check is then made as to whether the measured average temperature T lies in a predetermined or predeterminable range of permissible average temperatures. If this is so, "YES" applies, so that there can be a loop back to temperature determination 39. If, however, the interrogation 40 yields the answer "NO", the interrogation takes place at position 41 as to whether the measured average temperature T is higher than the maximum permissible average temperature $T_{max}$. If this is so, "YES" applies, so that, at position 42, suitable measures for lowering the average temperature T can be initiated. For example, the cooling gas mass flow conveyed through the cooling gas path 10 can be increased. For this purpose, for example, the power of the blower 4 can be increased correspondingly. Additionally or alternatively, a cooling gas inlet temperature, that is to say the temperature at which the cooling gas flows into the cooling gas path 10, can be lowered. Such a lowering of the cooling gas inlet temperature may be achieved, for example, by an increase in the power of the cooler 6.

If, however, the interrogation 36 yields the answer "NO", this means that the measured average temperature T lies below the desired permissible temperature values, so that the following applies:

$$T<T_{min}.$$

If this is so, at position 43, suitable measures for increasing the average temperature T can be initiated. For this purpose, for example, the cooling gas mass flow can be reduced. Additionally or alternatively, it is also possible to raise the cooling gas inlet temperature.

LIST OF DESIGNATIONS

1 gas turbine
2 housing
3 cooling device
4 cooling gas blower
5 cooling gas circuit
6 cooler
7 cooling gas supply device
8 cooling gas outlet of 7
9 cooling gas inlet of 7
10 cooling gas path in 2
11 first housing connection of 2
12 second housing connection of 2
13 switching device
14 first flow direction
15 second flow direction
16 first connection of 13
17 second connection of 13
18 third connection of 13
19 fourth connection of 13
20 first line in 13
21 second line in 13
22 third line in 13
23 first port of 13
24 second port of 13
25 third port of 13
26 first flap of 13
27 second flap of 13
28 third flap of 13
29 first path in 13
30 second path in 13
31 third path in 13
32 fourth path in 13
33 actuator
34 position in flowchart according to FIG. 4
35 position in flowchart according to FIG. 4
36 position in flowchart according to FIG. 4
37 position in flowchart according to FIG. 4
38 position in flowchart according to FIG. 4
39 position in flowchart according to FIG. 5
40 position in flowchart according to FIG. 5
41 position in flowchart according to FIG. 5
42 position in flowchart according to FIG. 5
43 position in flowchart according to FIG. 5

What is claimed is:

1. A device for cooling a housing of a gas turbine or a combustion chamber thereof, comprising:

a cooling gas supply device with a cooling gas outlet out of which a cooling gas stream flows during operation of the cooling gas supply device, and a cooling gas inlet via which the cooling gas stream flows back to the cooling gas supply device during operation of the cooling gas supply device;

a cooling gas path which is led through the housing in a circumferential direction thereof and which connects a first housing connection to a second housing connection;

a switching device for reversing a direction of flow of the cooling gas stream, the switching device being operable between a first switching position in which the switching device connects the cooling gas outlet to the first housing connection and the cooling gas inlet to the second housing connection, and a second switching position in which the switching device connects the cooling gas outlet to the second housing connection and the cooling gas inlet to the first housing connection.

2. The device of claim 1, wherein the switching device comprises:

a first connection connected to the cooling gas outlet;

a second connection connected to the cooling gas inlet;

a third connection connected to the first housing connection; and a fourth connection connected to the second housing connection;

a flap arrangement which in the first switching position defines a first path leading from the first connection to the third connection and a second path leading from the fourth connection to the second connection, and which in the second switching position defines a third path leading from the first connection to the fourth connection and a fourth path leading from the third connection to the second connection.

3. The device of claim 2, wherein the switching device comprises:

a first line leading from the first connection to the third connection;

a second line leading from the second connection to the fourth connection;

a first port controllable with a first flap and connecting the first line to the second line;

a second port controllable with a second flap and located in the first line;

a third port controllable with a third flap and located in the second line; and a third line connecting the second port to the third port;

wherein the first flap, in the first switching position, closes the first port and, in the second switching position, opens the first port and shuts off the first line between the first port and the second port;

wherein the second flap, in the first switching position, closes the second port and, in the second switching position, opens the second port; and wherein the third flap, in the first switching position, closes the third port and, in the second switching position, opens the third port and shuts off the second line between the first port and the third port.

4. The device of claim 3, wherein a common actuator is provided for the simultaneous adjustment of the three flaps.

5. A method for cooling a housing of a gas turbine or a combustion chamber thereof, the method comprising:

acting upon a cooling gas path with a cooling gas flow, the path being led through the housing in a circumferential direction thereof and connecting a first housing connection to a second housing connection; and varying a circumferential temperature difference of the housing between an outlet temperature measured at one of the housing connections and an inlet temperature measured at the other of the housing connections by changing a flow direction of the cooling gas in the cooling gas path.

6. The method of claim 5, wherein the circumferential temperature difference is reduced by raising a changeover frequency and is increased by lowering the changeover frequency.

7. The method of claim 5, wherein the flow direction of the cooling gas is changed whenever the circumferential temperature difference overshoots a predetermined limit value.

8. The method of claim 5, wherein the flow direction of the cooling gas is changed whenever the circumferential temperature difference overshoots a predeterminable limit value.

9. The method of claim 5, wherein an average temperature of the housing is varied by varying an inlet temperature of the cooling gas upon entry into the cooling gas path and by varying a mass flow of the cooling gas supplied to the cooling gas path.

10. The method of claim 9, wherein the average temperature of the housing is defined by a mean value of the inlet temperature and the outlet temperature.

11. The method of claim 5, wherein an average temperature of the housing is varied by varying an inlet temperature of the cooling gas upon entry into the cooling gas path.

12. The method of claim 11, wherein the average temperature of the housing is defined by a mean value of the inlet temperature and the outlet temperature.

13. The method of claim 5, wherein an average temperature of the housing is varied by varying a mass flow of the cooling gas supplied to the cooling gas path.

14. The method of claim 13, wherein the average temperature of the housing is defined by a mean value of the inlet temperature and the outlet temperature.

* * * * *